US006450881B2

(12) United States Patent
Smith

(10) Patent No.: US 6,450,881 B2
(45) Date of Patent: Sep. 17, 2002

(54) ROOM VENTILATOR INLET

(76) Inventor: James Norman Smith, 1070 Roch St., Winnipeg, Manitoba (CA), K2K 2R3

( * ) Notice: Subject to any disclaimer, the term of this patent is extended or adjusted under 35 U.S.C. 154(b) by 0 days.

(21) Appl. No.: 09/731,251

(22) Filed: Dec. 7, 2000

Related U.S. Application Data

(63) Continuation-in-part of application No. 09/397,878, filed on Sep. 17, 1999, now Pat. No. 6,167,575.

(51) Int. Cl.[7] ..... F24F 7/007
(52) U.S. Cl. ..... 454/345; 454/343
(58) Field of Search ..... 454/343, 347, 454/345, 354, 62

(56) References Cited

U.S. PATENT DOCUMENTS

| | | | | |
|---|---|---|---|---|
| 116,049 | A | * | 6/1871 | Gouge |
| 1,933,910 | A | * | 11/1933 | Hueglin |
| 2,068,426 | A | * | 1/1937 | Melin |
| 2,084,807 | A | * | 6/1937 | Hueglin |
| 2,087,637 | A | * | 7/1937 | Burt |
| 2,349,627 | A | * | 5/1944 | Kemmer et al. |
| 3,990,356 | A | * | 11/1976 | Keller |
| 4,362,091 | A | * | 12/1982 | Cox |
| 4,557,185 | A | * | 12/1985 | Harriman |
| 4,785,722 | A | * | 11/1988 | Dollhofp et al. |
| 4,867,047 | A | * | 9/1989 | Citron |
| 5,334,089 | A | * | 8/1994 | Beck et al. |
| 5,354,234 | A | * | 10/1994 | Arold et al. |
| 5,551,117 | A | * | 9/1996 | Bamman |
| 5,609,522 | A | * | 3/1997 | Szwartz |
| 5,669,815 | A | * | 9/1997 | Cakebread |
| 6,012,199 | A | * | 1/2000 | Litomisky et al. |

FOREIGN PATENT DOCUMENTS

| | | | |
|---|---|---|---|
| EP | WO 88/04535 | * | 6/1988 |
| GB | 2090966 A | * | 7/1982 |

* cited by examiner

*Primary Examiner*—David J. Walczak
*Assistant Examiner*—Khoa D. Huynh
(74) *Attorney, Agent, or Firm*—David J. French

(57) ABSTRACT

A room ventilation air inlet is mounted in a wall or ceiling to operate in conjunction with a central vacuum system as a suction source. Activation of a suction source connected by conduit to the inlet draws air from the room, removing odor and moisture. The air inlet has a valve to seal and open the air inlet. A single lever actuates both the valve and the central vacuum system.

1 Claim, 8 Drawing Sheets

ROOM VENTILATOR INLET

This application is a Continuation-in-part of application Ser. No. 09/397,878 filed Sep. 17, 1999 is now U.S. Pat. No. 6,167,575.

FIELD OF THE INVENTION

This invention relates to room ventilation systems. In particular, it relates to a wall or ceiling-mounted outlet to exhaust air from a room in a building, such as a bathroom or toilet room, through a central vacuum system.

BACKGROUND TO THE INVENTION

Room ventilation systems are known. Bathrooms in particular have switch-activated fans and ceiling-mounted outlets that remove air from bathrooms. The ventilation of bathrooms is particularly appropriate to remove odours and moisture.

This application concerns a new arrangement for ventilating a room, such as a bathroom. This invention also relies, in another aspect, upon the use of a central vacuum system as an exhaust means.

A prior art patent U.S. Pat. No. 3,587,437 issued to McEwen provides a ventilation outlet as part of a toilet paper system. However, the outlet is directly connected to a standard ventilator fan without provision for any local closure of the outlet when not in use.

A central vacuum system involves the installation of suction conduits throughout a house. These conduits terminate in multiple outlets that are individually sealed until accessed to take advantage of the suction created by the system to effect household cleaning.

A prior U.S. patent to Cavallero, U.S. Pat. No. 5,067,394 proposes to use a central vacuum system to evacuate odours from rooms, as well as smoke. In such applications, all vacuum outlets except the one in use must be kept closed to maintain suction at the active outlet. Cavallero acknowledges this, including the requirement for closing exhaust registers when vacuum inlets are to be employed. However, Cavellero does not address specific mechanisms to achieve this result.

The present invention addresses these background structures to propose a new combination that provides new and useful benefits for household room ventilation.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

According to one aspect of the invention an air outlet to exhaust air from a room through an exhaust system is provided. Preferably the exhaust outlet is a suction inlet which is mounted at any location within a room, such as a bathroom, and is coupled through a conduit to a central vacuum system as a suction source and air evacuation means. A switch means is provided to activate the central vacuum suction source and thereby effect exhaustion of air from the room through connecting conduits. A grill may be mounted over the suction inlet to screen and diffuse the air flow being sucked into the conduit.

The suction source is electrically activated by a switch that preferably is accessible to a person present in the room.

Preferably, the switch is carried by the same housing which carries the exhaust outlet of the invention. A conduit, preferably concealed within walls, connects the exhaust outlet/suction inlet, to the suction source located at a remote location. Activation of the switch draws air from the room being ventilated to the suction source, whereafter the air is ejected by the suction source either to the outside environment or into a remote room, such as a household basement.

In the case of a central vacuum system, multiple wall-mounted room suction inlets are generally provided, each with their own closure. Failure to effect closure of unused suction inlets will result in loss of suction intensity at a used suction inlet. To adapt the room air exhaust outlet described above to a central vacuum system, a conduit closure means or valve is provided. This valve is carried by the housing for the suction inlet. Until this valve is opened, the suction inlet of the invention is sealed. This maintains the viability of the central vacuum system. It is a preferred feature of the invention that activation of a common control lever serves to both mechanically open the conduit valve and electrically activate the suction source. The conduit may be closed, in one embodiment, by passing a valve plate transversely across the air flow path and conduit access opening. Optionally, the lever may operate the conduit valve through a solenoid.

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENT

Figure 1:
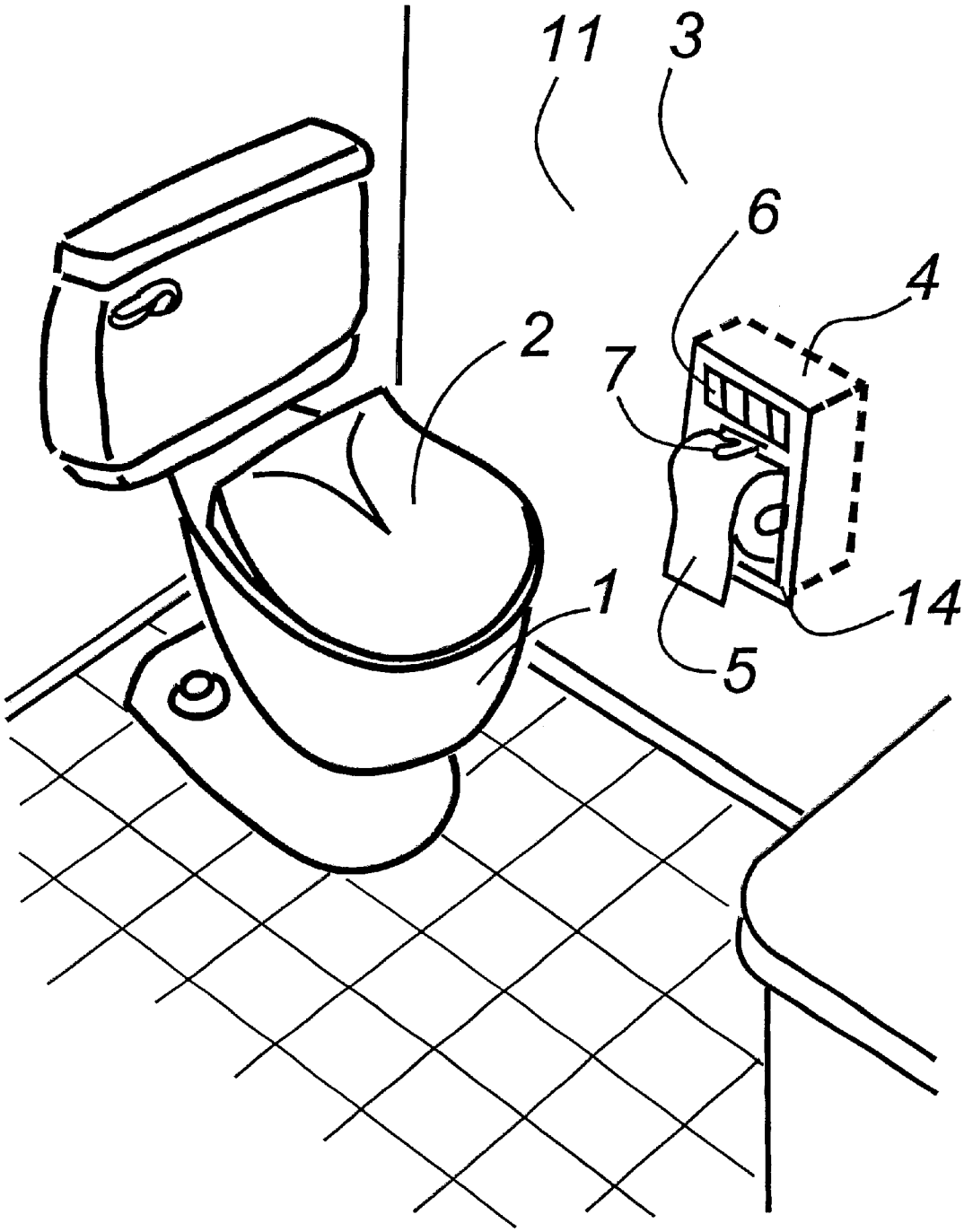
FIG. 1 is a perspective view of a bathroom interior with a toilet and adjacent wall-mounted toilet paper dispenser with exhaust outlet/suction inlet, according to the invention.

In FIG. 1 a toilet 1 with a seat cover 2 is installed adjacent to a wall 3 in a bathroom 11. In the wall 3 a toilet paper dispenser housing 4, carrying toilet paper 5, is installed. Mounted in the dispenser housing 4 is an air evacuation opening 6 to remove air from the bathroom 11. A lever 7 activates an electrical switch 9 that turns-on a suction source 10 mounted remotely from the bathroom 11. A conduit 12 for evacuating air extends between the suction source 10 and the air evacuation opening 6. Activation of the lever 7 also opens a conduit valve 13 within the housing 4 that otherwise seals the conduit 12.

Figure 2:
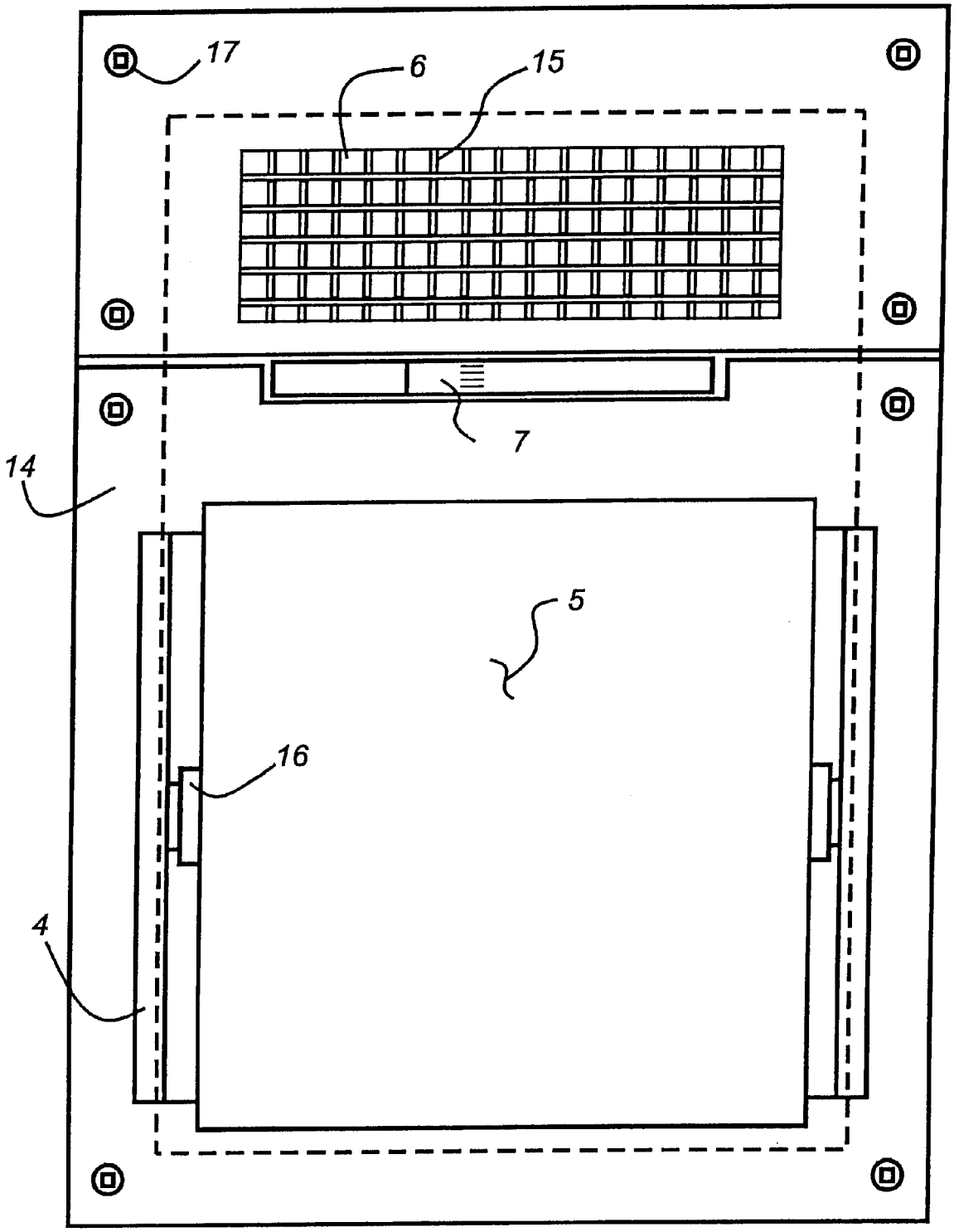
FIG. 2 is a face view of the front plate of the dispenser of FIG. 1.

FIG. 2 shows the face plate 14 carried by the frame 4 as mounted in the wall. Screws 17 attach this plate 14 to the frame 4. A grill 15 overlies the exhaust opening 6. A spindle 16 passing through the roll of toilet paper 5 is fitted to the housing 4.

Figure 3:
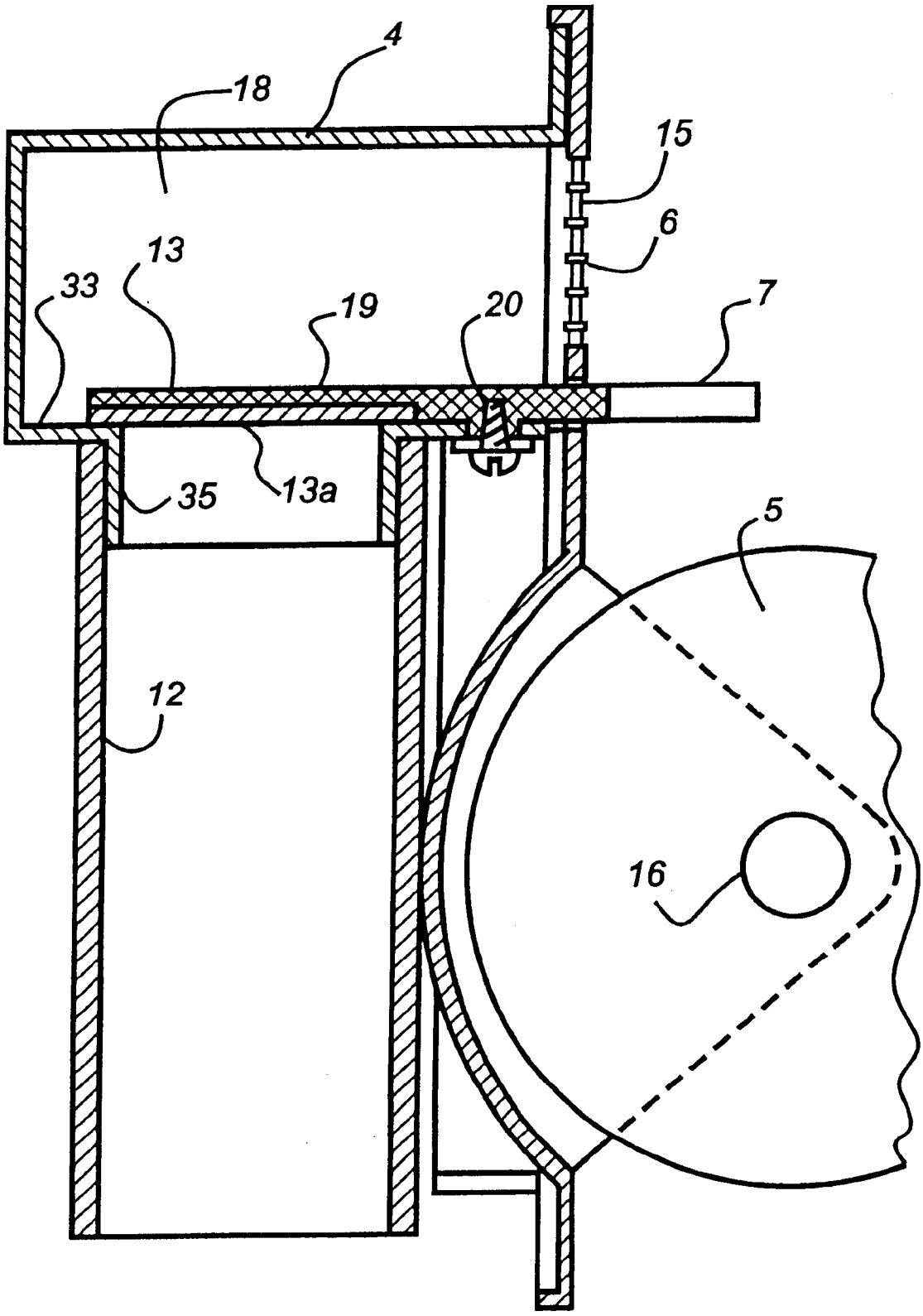
FIG. 3 is a cross-sectional side view of the dispenser of FIG. 1.

FIG. 3 shows the presence of a plenum 18 behind the grill 15 separated from the conduit 12 by the valve plate 13. The valve plate 13 is carried by a lever arm 19 that swings about hinge screw 20 when the lever 7 is rotated sideways. Hinge screw 20 is mounted on housing 4 to allow the valve plate 13 to move transversely over the exhaust outlet aperture 35 accessed by the end of conduit 12.

Figure 4A:
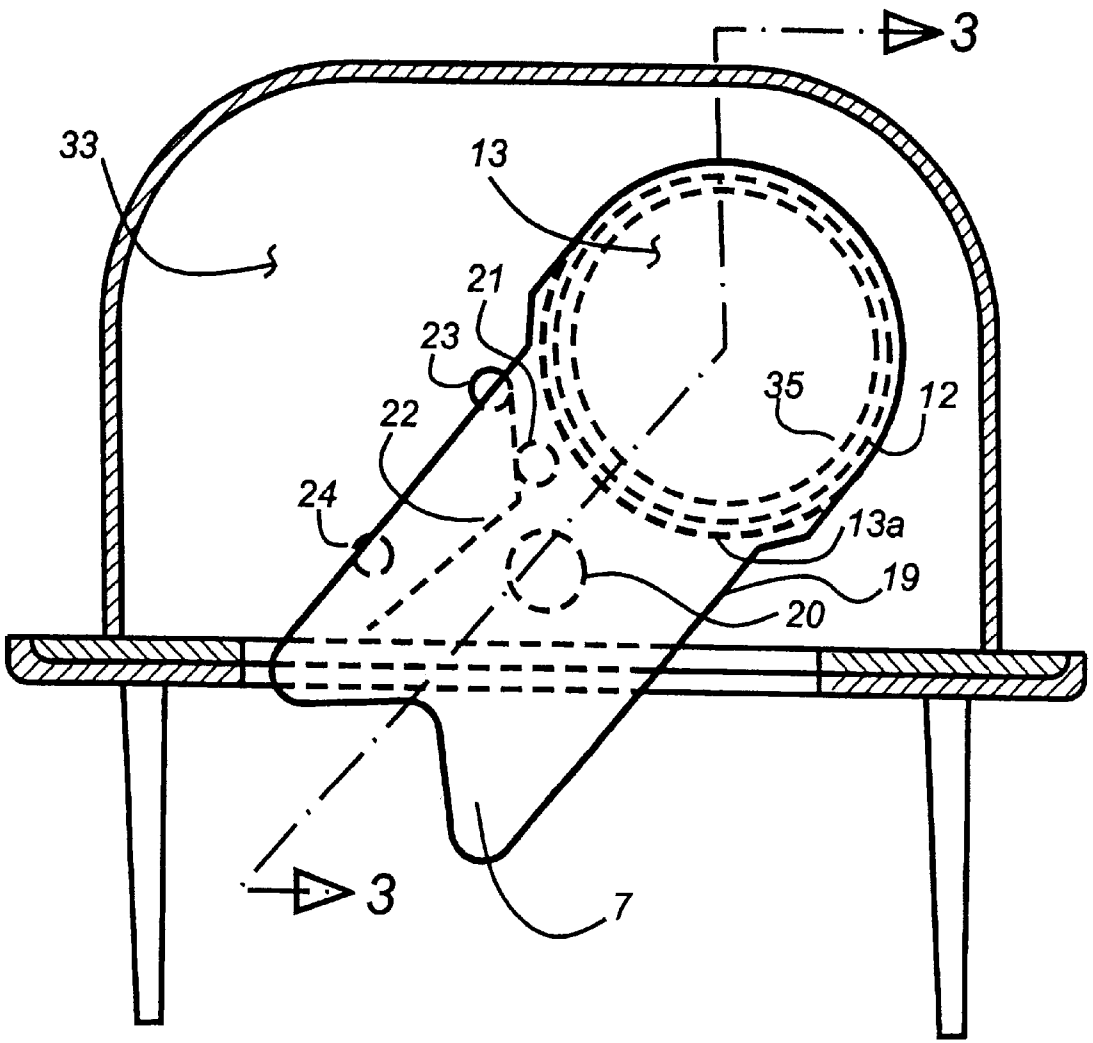
FIGS. 4A and 4B are cross-sectional plan views of the dispenser of FIG. 1, taken just above the conduit valve lever, respectively showing the conduit sealed and open.
Figure 4B:
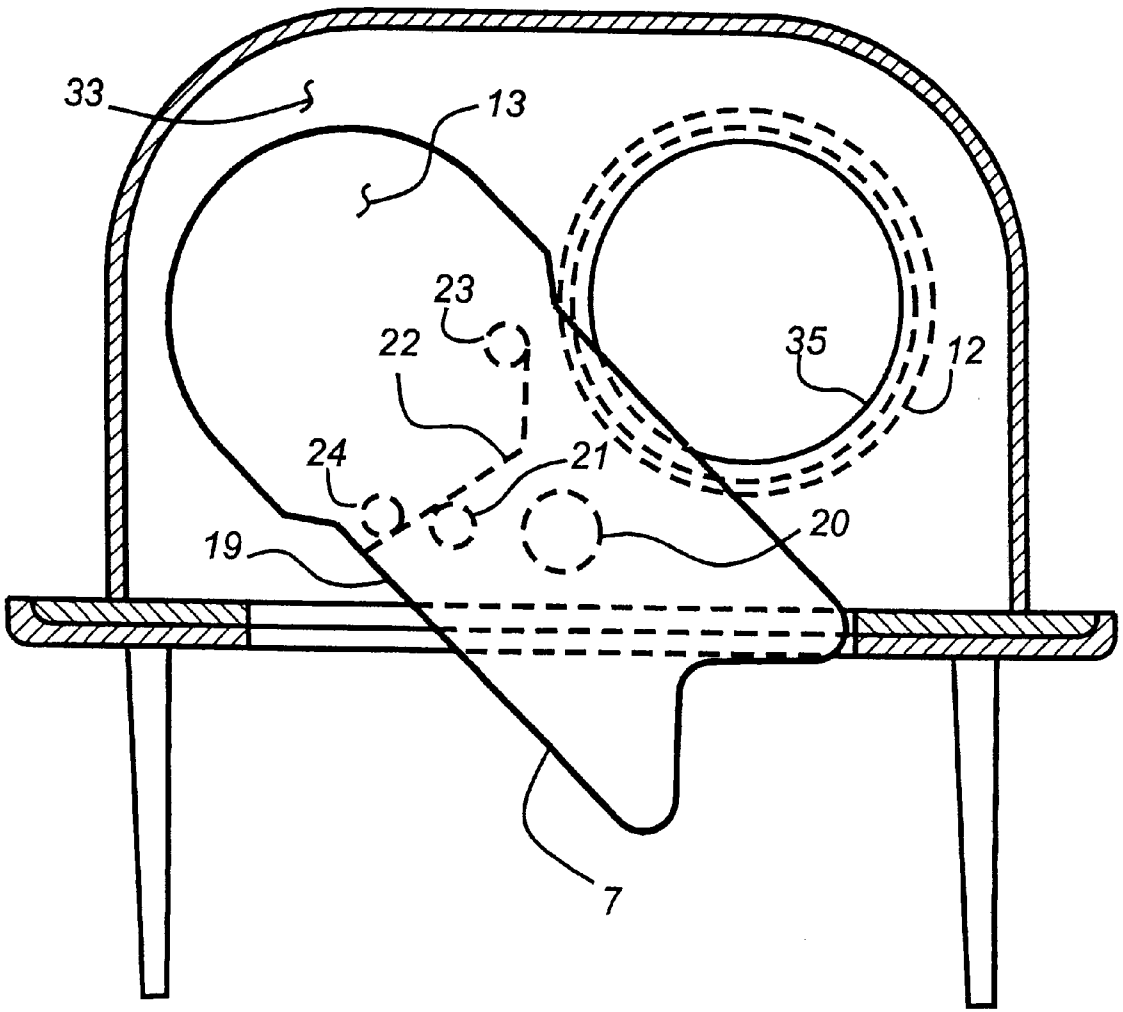

In the plan views of FIGS. 4A, 4B the action of swinging the lever 7 is shown as opening and sealing the conduit 12 by transversely removing and replacing the valve 13 with its gasket 13a over the end of the conduit 12. The activated, conduit "open" position is shown in FIG. 4B. The closed, "off" position is shown in FIG. 4A. The action of swinging the lever arm 19 causes a pin 21 carried on the underside of lever arm 19 to press a spring wire 22 mounted on a seat 23 carried by plenum floor 33 which separates the air flow from the toilet paper so as to bear against electrical contact 24. This closes a low voltage circuit which activates relay 9 and turns on the suction source 10.

The spring 22 may be bent to provide a detent to effect a "toggle" action that stabilizes the lever arm 19 in either the closed or open position. The fit of the lever arm 19 with the hinge screw 20 may have sufficient play or looseness to allow the surface of valve gasket 13*a* to be carried over the upper end of the opening 35 that provides an entry into conduit 12.

Figure 5:
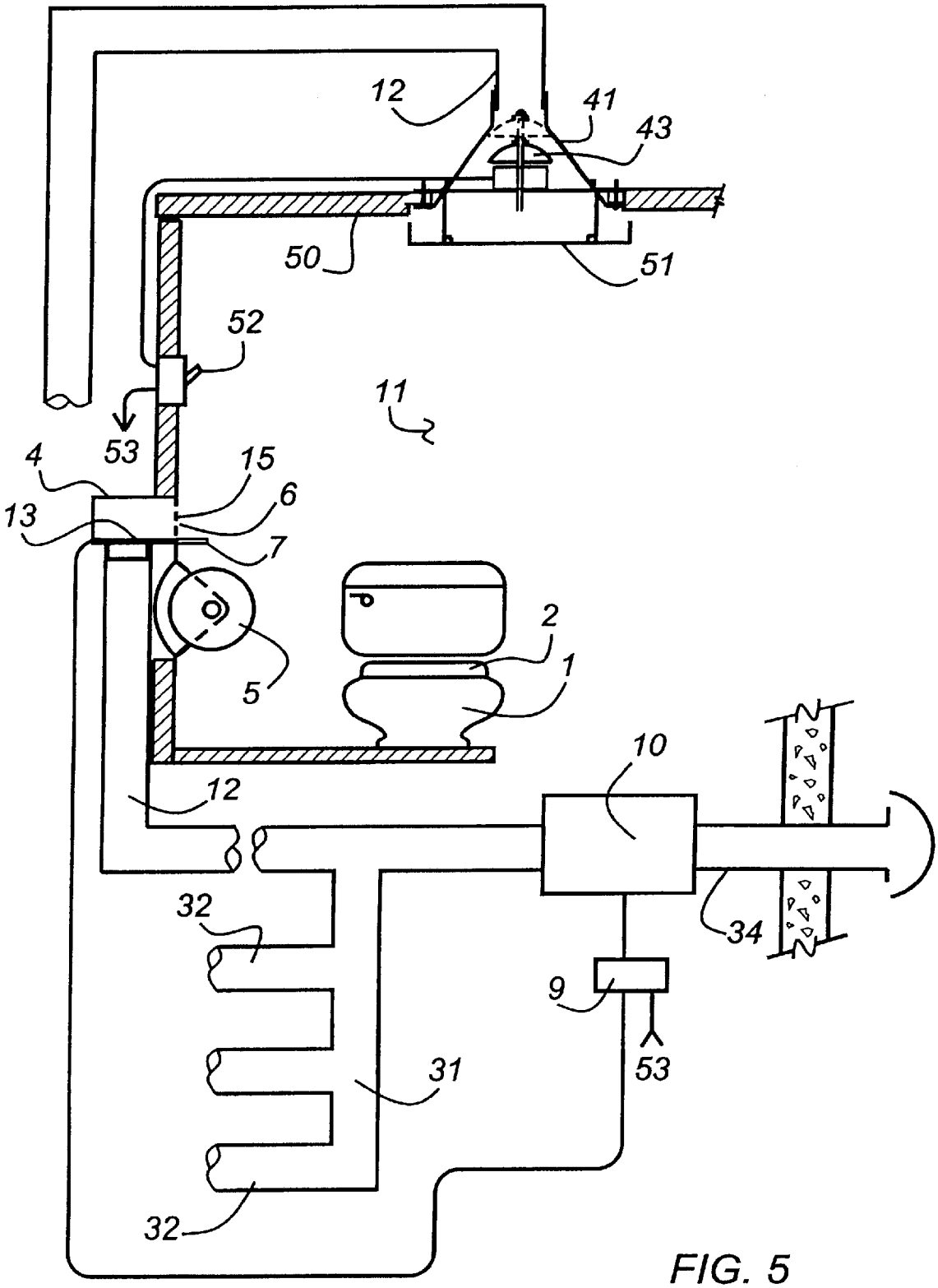
FIG. 5 is a schematic view of the conduit system terminating at a suction source that evacuates air from the bathroom, either through a toilet paper holder outlet or through a ceiling mounted outlet.

In FIG. 5 the suction source 10 is the suction generator of a central vacuum system. The activation of suction source 10 causes air drawn from the bathroom 11 to be exhausted outside by vent pipe 34. Other conduits 32 connected through a manifold 31 to the suction source 10 remain sealed while conduit 12 is open. Conversely, with valve 13 shut, the other conduits 32 will be functional to provide suction.

Figure 6:
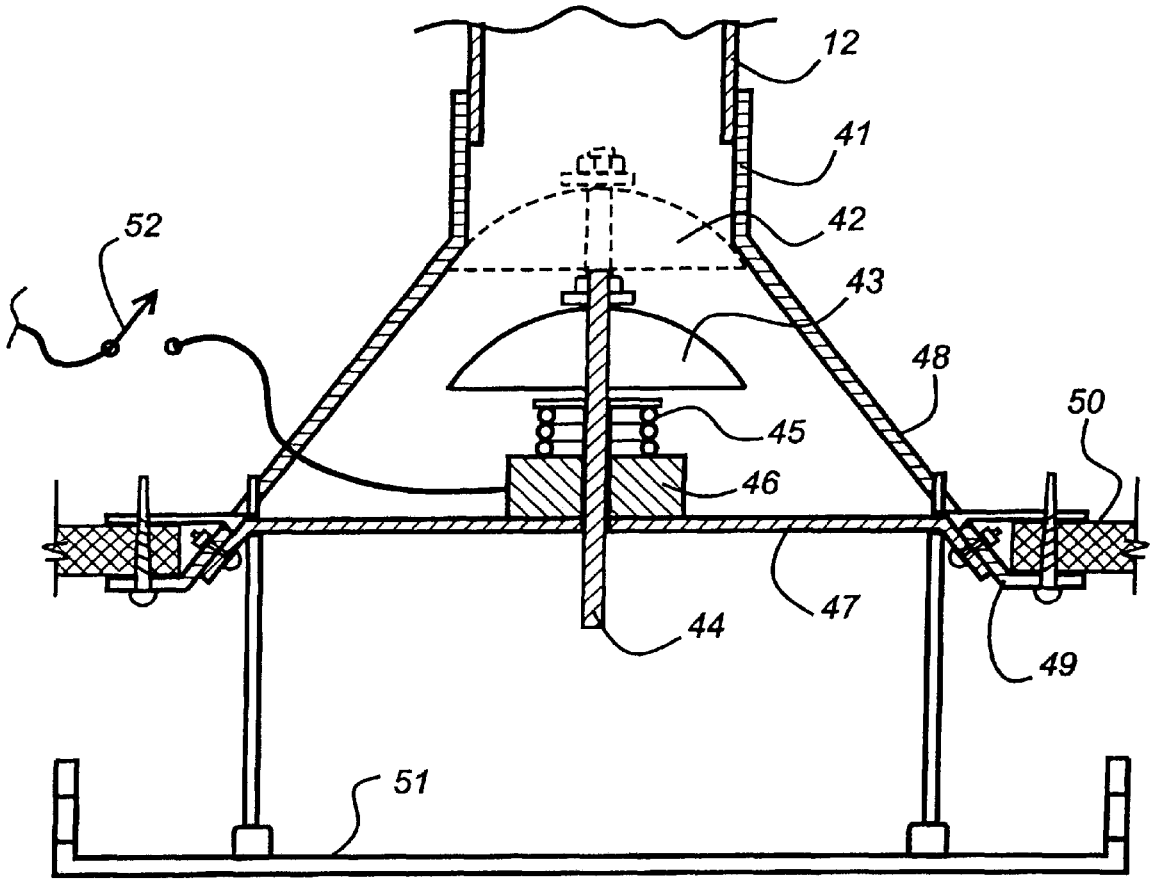
FIG. 6 is a detailed cross-sectional side view of the ceiling mounted outlet of FIG. 5.

In FIG. 6, the alternate ceiling mounted outlet 40 present in FIG. 5 is shown in a detailed cross-section. The conduit 12 is coupled to a complementary coupling section 41 which has a downwardly-directed open end 42 into which a sealing member 43, shown shaped as a hemisphere, may enter to serve as a valve. The sealing member 43 is carried on a plunger 44 that passes through a spring 45 and solenoid coil 46. The coil 46 rests on a transverse support 47 that connects to the frame 48 supporting the coupling section 41. Flanges 49 allow the frame 48 to be connected to the ceiling 50. A cover plate 51, shown at a partially disengaged location, may be provided to conceal the mechanism aesthetically.

The spring 45 urges the plunger 44 to carry the sealing member 43 upwards to cover the open end 42 and seal the conduit 12 against vacuum loss. Activation of the solenoid coil 46 withdraws the plunger 44 and sealing member 43, opening the end 42 of the coupling section 41. A switch 52, conveniently mounted on the room wall, serves as a lever to provide current both to the ceiling solenoid 46, through wire 53, and to the relay 9 to activate the suction source 10.

Figure 7:
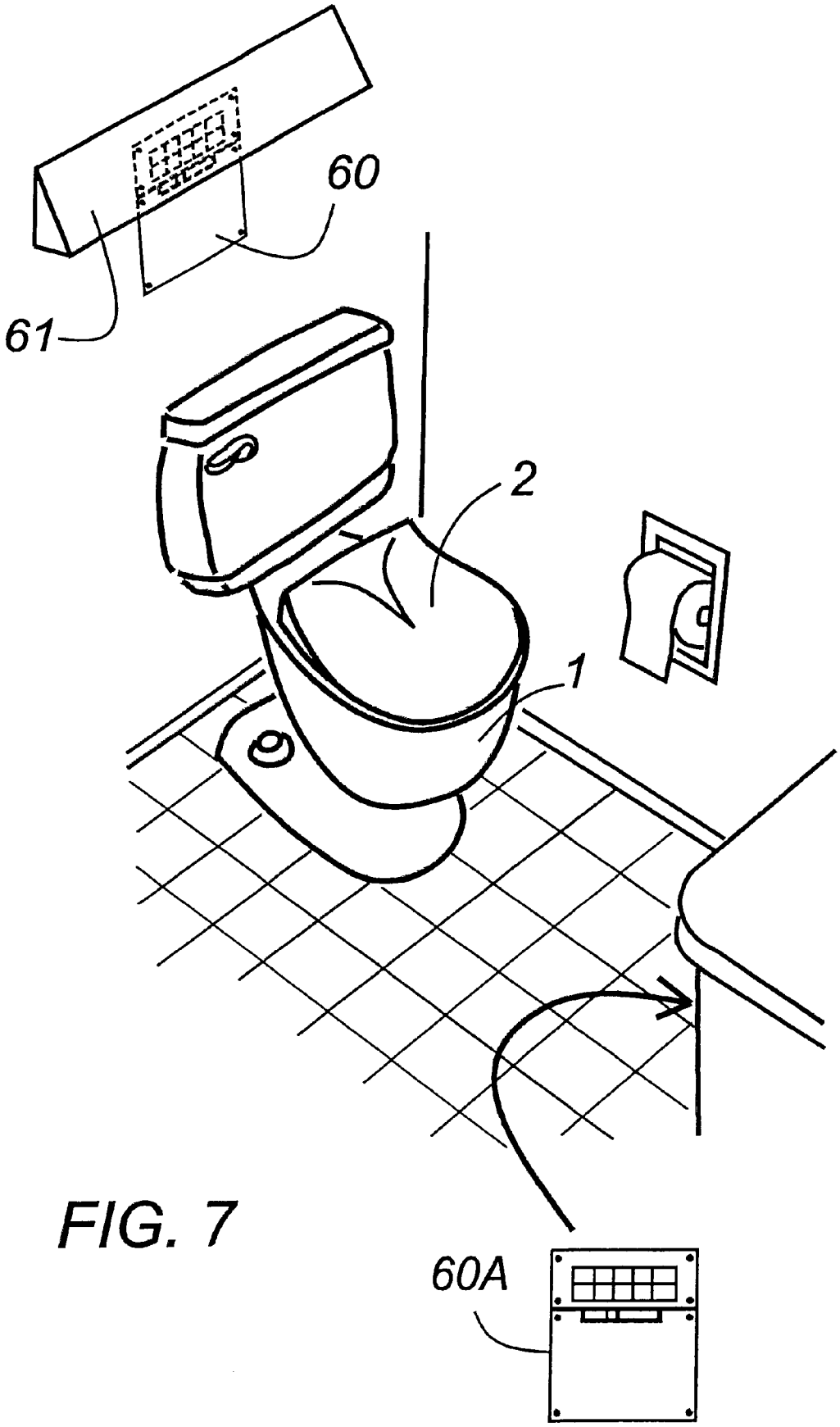
FIG. 7 is a depiction of a wall mounted outlet similar to that of FIG. 1 but locating the ventilation outlet separately from the toilet paper dispenser.

In FIG. 7 a ventilation outlet/suction inlet 60 is mounted in a wall. A hood 61 overlies this inlet 60 to concentrate air flow in the region from which odours originate. This inlet 60 is similar to the assembly of FIG. 1 except it lacks a toilet paper dispenser.

Alternately, an inlet 60A may be mounted in the wall of a table or vanity.

Thus, it has been shown how a wall or ceiling-mounted exhaust outlet may be provided in a room, such as a bathroom to remove odorous air therefrom in response to ready activation by a user of a switch that both opens an exhaust conduit and activates a suction source. By using the remotely located fan of a central vacuum system as the suction source 10, high volumes of air may be extracted from such a room without the intrusion of noise from a locally installed exhaust fan. By providing a sealed termination at the conduit end of a central vacuum system, the central vacuum system is able to continue to operate in the normal manner through the manifold 31 when the exhaust outlet is closed. Operation of the central vacuum system is only disabled for a short time during activation of the exhaust outlet of the invention.

By combining the action of electrically actuating the central vacuum system with opening the suction inlet, the invention provides a simple functionality that is convenient and simple for users to operate.

Conclusion

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

The embodiments of the invention in which an exclusive property or privilege is claimed are defined as follows:

1. A room air exhaust system for a room having walls comprising:

a suction inlet carried in a housing which is mounted in a wall of a room, said inlet having a valve means with open and closed positions for permitting and sealingly interrupting a flow of air through said inlet;

a grill carried by said housing through which the flow of air must pass;

a conduit connected to the suction inlet to receive and carry-off air entering therethrough;

a central vacuum cleaner suction generator with multiple vacuum service outlets to serve as a suction source connected through said conduit to the suction inlet;

an electrical switch connected for activation of the suction source; and, a control lever connected to the valve means to actuate said valve means, wherein the control lever is mounted to said housing to both open the valve means and activate at the same time the electrical switch for turning on the suction source and wherein, with said valve means in said closed position, the central vacuum cleaner suction generator provides suction to said multiple vacuum service outlets; and wherein the valve means comprises a sealing plate formed on one end of the control lever, said sealing plate being pivotally displaceable about a pivot point to move transversely with respect to the air flow through said inlet to close and open said inlet, said control lever acting as a first class lever with two arms on opposite sides of the pivot point, one of said arms carrying said sealing plate, the other of said arms being a manually accessible lever arm extending outwardly from said housing for actuation of said control lever.

* * * * *